US006634415B1

(12) United States Patent
Maddock et al.

(10) Patent No.: US 6,634,415 B1
(45) Date of Patent: Oct. 21, 2003

(54) CONTINUOUS EXTRUSION USING DYNAMIC SHOE POSITIONING

(75) Inventors: Brian Maddock, Dorset (GB); Martin James Smith, Dorset (GB)

(73) Assignee: Holton Machinery, Bournemouth (GB)

( * ) Notice: Subject to any disclaimer, the term of this patent is extended or adjusted under 35 U.S.C. 154(b) by 0 days.

(21) Appl. No.: 09/600,491

(22) PCT Filed: Nov. 16, 1999

(86) PCT No.: PCT/GB99/03818

§ 371 (c)(1),
(2), (4) Date: Jul. 12, 2000

(87) PCT Pub. No.: WO00/29141

PCT Pub. Date: May 25, 2000

(30) Foreign Application Priority Data

Nov. 16, 1998 (GB) ..... 9825106

(51) Int. Cl.[7] ..... B22D 11/00; B21C 23/00

(52) U.S. Cl. ..... 164/482; 164/453; 164/454; 164/433; 164/434; 164/155.1; 164/151.2; 72/262; 72/468

(58) Field of Search ..... 164/482, 453, 164/433, 434, 155.1, 151.2; 72/262, 468

(56) References Cited

U.S. PATENT DOCUMENTS 4,052,958 A * 10/1977 Delves ..... 118/119
4,603,573 A * 8/1986 Ganago et al. ..... 72/454
5,000,025 A * 3/1991 Beekel ..... 72/259
5,022,258 A * 6/1991 Wilson ..... 73/37.5
6,041,638 A * 3/2000 Pinomaa et al. ..... 72/262

FOREIGN PATENT DOCUMENTS

| | | | |
|---|---|---|---|
| EP | 0 213 943 | | 3/1987 |
| EP | 0213943 | * | 3/1987 |
| GB | 2 310 627 | | 9/1997 |
| JP | 60-15018 | | 1/1985 |

* cited by examiner

*Primary Examiner*—Tom Dunn
*Assistant Examiner*—I. H. Lin
(74) *Attorney, Agent, or Firm*—Fay, Sharpe, Fagan, Minnich & McKee, LLP

(57) ABSTRACT

A continuous extrusion machine has a chassis (1) supporting a wheel (2) for rotation by a motor. An endless groove (7) extends around the periphery of the wheel (2). A shoe (3) is mounted in the chassis (1) and has an enveloping surface shaped to closely envelop an arc of the wheel (2) periphery so that the groove (7) co-operates with the shoe (3) to form a passage. An abutment is mounted on the shoe (3) to extend into the passage at a downstream end. Tooling is mounted in the shoe (3) including a die such that a material such as aluminium or copper bar fed into the groove (7) is extruded through the die as a consequence of the energy transfer via friction from the rotating wheel (2). A gap (12) exists between the enveloping surface and the wheel (2). The gap (12) is used to provide the orifice of a sonic gap (12) sensor whereby the size of the gap (12) can be accurately and directly measured. The gap (12) size sensed is used to control the position of the shoe (3) in two directions mutually perpendicular to the rotary axis of the wheel (2) by adjusting support structures which support the shoe (3). The size and shape of the gap (12) can thus be safely adjusted while the machine is extruding allowing the size and shape of the gap (12) to be adjusted for optimum performance.

17 Claims, 7 Drawing Sheets

CONTINUOUS EXTRUSION USING DYNAMIC SHOE POSITIONING

BACKGROUND OF THE INVENTION

The present invention is concerned with a continuous extrusion machine, and a method of operation for continuously extruding non-ferrous metals such as aluminium and copper.

In general a continuous extrusion machine comprises a chassis a wheel and tooling. The tooling consists principally of a shoe and a die. The chassis supports the wheel for rotation by a motor. An endless groove is formed in the periphery of the wheel into which is entrained a feedstock which is commonly a bar of a non-ferrous metal such as aluminium or copper but may comprise metal particles or molten metal. Part of the periphery of the wheel is closely enveloped by the shoe so that the groove cooperates with the shoe to form a passage in use feedstock entrained in the groove enters the passage at an open end as the wheel rotates. The other end of the passage is obstructed by an abutment which is mounted on the shoe and intrudes into the passage. Because the feedstock is confined in the passage and the wheel continues to rotate, the feedstock is heated by friction with the groove. A die is mounted in a chamber formed in the shoe immediately upstream of the abutment. Eventually the thermal and other stresses imposed on the feedstock cause the feedstock to extrude through the die.

The continuous extrusion machine is capable of continuously extruding a wide range of sections of non-ferrous metal, for so long as feedstock is delivered to the groove.

In order to operate successfully it is necessary to have a small gap between the periphery of the wheel and the shoe. This gap permits a small quantity of the feedstock known as the flash, to extrude out of the passage onto the periphery of the wheel and into the gap. The size of the gap has a significant effect on the performance of the machine in terms of the speed, quality and type of extrusion which can be produced. Conventionally the gap is set before starting the machine. However, when the machine is in operation heat causes thermal expansion of the machine components and pressure on the wheel and chassis causes elastic deformation so that the gap size changes.

Thermal expansion typically alters the gap by up to 0.7 mm while elastic deformation alters the gap by between 0.3 and 0.5 mm. The effects of thermal expansion and extrusion pressures are non-uniform, will vary during start up, and may vary during operation and conventionally cannot be measured accurately.

The elastic deformation is relieved when feedstock ceases to enter the machine, as at shut down, and it is essential that the shoe does not impinge on the wheel or serious damage will occur. It is consequently not possible to pre-set the machine to run with a gap of less than the elastic deformation. It is also disadvantageous that the gap cannot be varied and accurately measured during machine operation in order to test the performance of various clearances in the production of an extrusion.

Accordingly the present invention provides a continuous extrusion machine having a chassis supporting a wheel for rotation and a shoe enveloping a span of the periphery of the wheel and co-operating with a groove formed in the periphery of the wheel to form a passage, a support mechanism supporting said shoe and/or wheel to be relatively displaceable in a direction perpendicular to the axis of rotation of the wheel during use, a gap sensor system able to sense the size of a gap between the wheel periphery and the shoe when the machine is operating, and control means responsive to the gap sensor to adjust the support mechanism to displace the shoe relative to the wheel.

The gap sensor system may also sense the shape of the gap.

In practice it is preferable to support the shoe via the support mechanism. However, the fundamental objective is to be able to accurately control the gap size and shape and so the displacement of the wheel relative to the chassis is deemed within the broad concept of this invention. Also within the scope of this invention is the displacement of the shoe and the wheel relative to the chassis particularly where it may be convenient to displace the shoe on one axis and the wheel on another.

A preferred support mechanism comprises a hydraulic wedge assembly having a wedge longitudinally displaceable against a complementary ramp. The ramp engages and supports the shoe and is constrained to move in a direction towards or away from the wheel. By mounting such a support mechanism at a tangent to the wheel so that shoe displacement is radial it is possible to control the gap size. However, a unidirectional active shoe positioning system is less than wholly satisfactory at least in part because of difficulties in adapting different shoe types used for radial and tangential mode extrusion and because it is desired to control the shape of the gap in addition to its size. To completely control both the size and the shape of the gap, as independent variables, it is preferred to provide the support mechanism with a first and a second wedge assembly. The first wedge assembly is disposed to displace the shoe in a first direction perpendicular to the axis of rotation of the wheel and the second wedge assembly is disposed to displace the shoe in a direction perpendicular to the rotary axis of the wheel and the first wedge assembly. The directions will ordinarily be the vertical and horizontal.

It is preferred that each wedge assembly includes an hydraulic ram to longitudinally displace the wedge.

Although wedges, ramps and rams are thought to be the best way of implementing the support mechanism at this time it is conceived that the use of hydraulic rams alone or ball screw driven rams may be capable of providing a support mechanism.

Means such as Poly-Tetra-Fluoro-Ethylene (PTFE) surfaces may be provided to reduce the friction between the wedge and the wedge bearing.

Preferably, where two wedge assemblies are provided to implement a bi-directional dynamic or active shoe positioning process, it is preferred to provide a gap sensor system having three gap sensors each located peripherally spaced from the other, to sense the size and shape of the gap.

An alternative arrangement would be for the shoe to be supported in the chassis by means of a pivot and swung into position to set the gap size. By supporting the pivot to be displaceable radially via the operation of a first actuator such as an hydraulic ram, and arranging for a second actuator such as a second hydraulic ram to be capable of swinging the shoe around the pivot, the size and shape of the gap may be dynamically adjusted during machine operation in accordance with the size and shape of the gap sensed by the gap sensor.

In order to sense both the size and shape of the gap the gap sensor system will preferably comprise a plurality of gap sensors deployed to detect the gap size at positions spaced circumferentially around the wheel.

Preferably the gap sensor system comprises gap sensors which sense the gap size directly to avoid the corrections required if the gap size and shape is sensed indirectly. To this end each gap sensor must tolerate the hostile environment at the interface between the wheel and the shoe while continuing to measure with accuracy of the order of 0.1 mm, so that a gap size of 0.2 mm can be accurately set. The sensor range will preferably exceed 0.5 mm to facilitate starting the machine and ideally will exceed 1 mm. The preferred form of sensor is a sonic gap sensor.

A sonic gap sensor relies on the principle that fluid flow through an orifice will choke when a fluid pressure upstream of the orifice reaches a critical pressure at which the flow through the orifice is sonic. In this condition the fluid condition downstream of the orifice has no influence on the conditions upstream of the orifice. When the orifice is choked the fluid condition upstream of the orifice correlates with the size of the orifice. By making the gap the orifice the size of the gap can be measured. Thus the gap . sensor of the present invention consists of at least one port located in the shoe adjacent the gap and a gas delivery pipe for delivering compressed gas to the port at or above the critical pressure. Pressure sensitive transducers are deployed in the gas delivery pipe in order to sense the gas pressure in the pipe. Once calibrated, changes in the gas pressures sensed can be used to determine the size of the gap adjacent the port. Thus the gap size can be determined by coupling the pressure transducers to a computer or other dedicated processor of the control means.

Sensors other than sonic gap sensors as presently available cannot tolerate the environment in the gap for sufficient time to be practical in a production machine. Improvements in the environmental tolerance of such sensors or even completely new types of sensor would obviously require reconsideration of the applicability of the sensor to this invention for directly sensing the gap size.

SUMMARY OF THE INVENTION

Indirect sensing of the gap size,, (ie. computation of the gap size from remote measurements) has been contemplated because this avoids many of the difficulties inherent in locating a sensor in the hostile environment within the gap. Sensors considered potentially suitable for indirect sensing include eddy current sensors, proximity sensors, optical sensors and hall effect sensors. Systems in which the gap size is sensed indirectly are considered to be within the broadest scope of this invention. Sensors from the previously mentioned list may be used to sense the gap by sensing the relative positions of the shoe, the wheel and possibly the chassis. Such a system will require the data from the indirect sensor(s) to be corrected for thermal and mechanical strain on the, wheel shoe and chassis. While not impossible the difficulties of correction are believed to be more disadvantageous than the difficulties of directly sensing the gap size.

The majority of material in the gap is confined to the areas of the wheel adjacent to the groove. When using gap sensors wheels 50 mm wider than is conventional are used and the sensors operate at the outer 25 mm which is clear of the flash. It is preferred to locate one gap sensor adjacent the mouth of the start of the tooling, one at the centre of the tooling and one immediately downstream of the abutment. So that the gap is the only significant constriction in the gap sensor, each port has a diameter approximately four times the maximum size of the gap. Preferably each gap sensor will comprise one port, overlying the edge of the wheel and communicating with an elongate gas delivery pipe. The gas port pressure (P) may be measured slightly upstream of the ports (e.g. at about 0.05 m) and a delivery pressure (P.) far upstream of the ports (e.g. at about 0.750 m). The ratio of the port pressure to the delivery pressure is approximately proportional to the size of the gap.

Conventionally a scraper is required to remove excess flash from the wheel rim during machine operation in order to prevent the flash build up from fouling the gap as it re-enters the shoe. However, problems arise in setting the scraper position relative to the wheel because of thermal expansion and blade tip wear during machine operation which alters the relative position of the scraper blade and the wheel. To alleviate this there may be provided a scraper carrier supported for radial displacement toward and away from the wheel rim and supporting a scraper blade at its tip adjacent the wheel rim. The scraper carrier is rendered radially displaceable during machine operation by a device such as an eccentric shaft, and a motor arranged to rotate the shaft to a degree determined by the control device. The control device responds to a gap sensor mounted on the tip of the scraper carrier to determine the separation the scraper blade tip and the wheel rim.

According to another aspect of the present invention there is provided a method of operating a continuous extrusion machine wherein feedstock is entrained in a groove formed in the periphery of a wheel rotating in a chassis and drawn into a passage formed between the groove and a shoe, said passage being obstructed by an abutment supported by the shoe so that friction between the shoe and the abutment will cause the feedstock to extrude through a die supported in the shoe, comprising the steps of: sensing the actual size of a gap between the wheel and the shoe, comparing the actual size of the gap with a predetermined or previous gap size in a control means to determine if there is a difference, said control means responding to a difference to control a support structure which supports the shoe and/or the wheel in the chassis to displace the shoe and/or the wheel on at least one axis perpendicular to the axis of rotation of the wheel so that the gap is changed to reduce the difference.

The sensing of the gap size and the adjustment of the shoe position take place during operation of the machine. This may include the start up operation of the machine before extrusion has begun. As the machine warms up from a cold start, the gap size may be sensed continuously but is preferably sensed at intervals. When the gap size differs from a previous value, or possibly when it diverges from a predetermined value, a control device of the control means responds to adjust the support structure so that the shoe is moved relative to the wheel to bring the gap size back towards the desired size.

The desired gap size may be altered during machine operation. Thus while the method contemplates setting the gap size to that required for extrusion, and preventing significant deviation during extrusion, it also contemplates setting the gap size to one predetermined value during machine start up, altering that predetermined value during continuous extrusion and possibly further altering the value during shut down of the machine.

The method of sensing the gap size preferably comprises blowing air or another pressurised gas such as an inert gas through the gap at at least one, and possibly two or preferably three circumferentially spaced points adjacent the passage. The pressure with which the air is blown is sufficient to ensure that the gap is choked and the pressure in a delivery pipe upstream of the gap can then be sensed and correlated with the gap size. It is preferred to sense the pressure and hence the gap at intervals in order to minimise the gas requirement.

The method may also comprise the steps of sensing the shape of the gap, in particular by sensing the size of the gap at two or more peripherally spaced locations and the step of adjusting the shape of the gap to a desired shape.

BRIEF DESCRIPTION OF DRAWINGS

Continuous extrusion machines and a method of operating them, embodying biaxial shoe positioning in accordance with the present invention will now be described, by way of example only, with reference to the accompanying drawings in which, FIG. 1 diagrammatically illustrates a continuous extrusion machine set up for radial shoe operation, FIG. 2 diagrammatically illustrates a continuous extrusion machine set up for tangential shoe operation.

DESCRIPTION OF PREFERRED EMBODIMENTS

Figure 1:
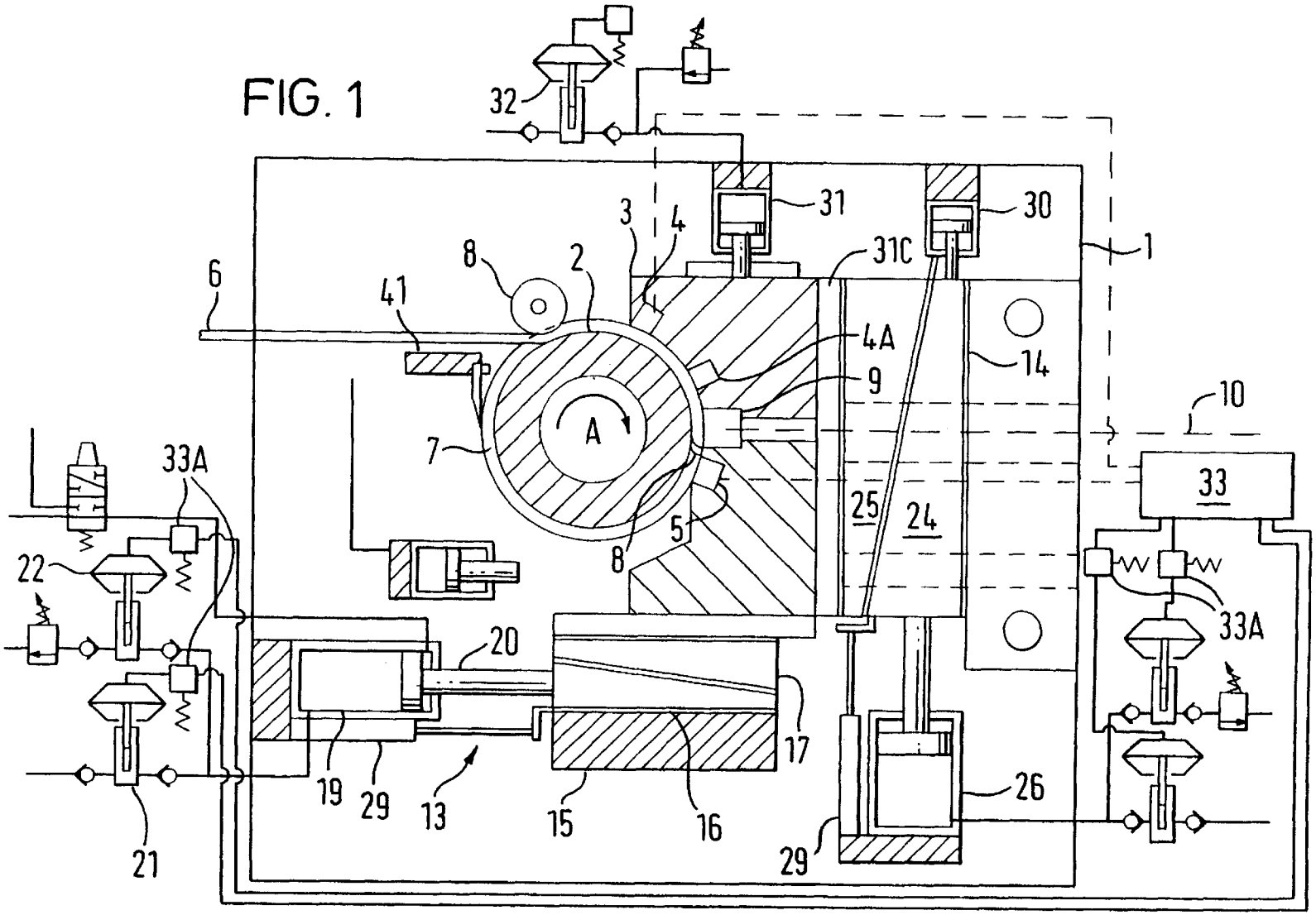

With reference to the drawings a continuous extrusion machine comprises a chassis 1, a wheel 2 mounted in the chassis for rotation about a horizontal axis, a shoe 3, 3' a shoe support mechanism, described in detail below and a gap sensor system comprising three sonic gap sensors 4, 4A, 5. The machine is illustrated in the process of extruding a bar 6 of cast non- ferrous metal feedstock such as aluminium or copper. The feedstock is entrained by means of a coining roll 8 in an endless groove 7 formed in the periphery of the wheel 2. As the wheel rotates in the direction of the arrow "A" the bar 6 passes into an enclosed passage formed between the shoe 3, 3' and the periphery of the wheel 2.

Movement of the bar 6 through the passage is stopped by an abutment 8. The wheel 2 is rotated by a motor (not shown) so that friction heats and compresses the bar 6 until it becomes sufficiently plastic to extrude out of the passage 7 into tooling 9 which includes a die. In the case of the radial mode of operation shown in FIG. 1 the shoe presents the die so that the extrusion 10 passes from the machine radially with reference to the wheel 2. In the case of the tangential mode machine shown in FIG. 2 the shoe 3' is adapted to accommodate tooling 9' which has the extrusion 10' passing from the machine at a tangent to the wheel 2.

The radial mode machine is best suited to the production of profiled sections and tube while the tangential mode is suited to sheathing and cladding a core 11.

Figure 3:
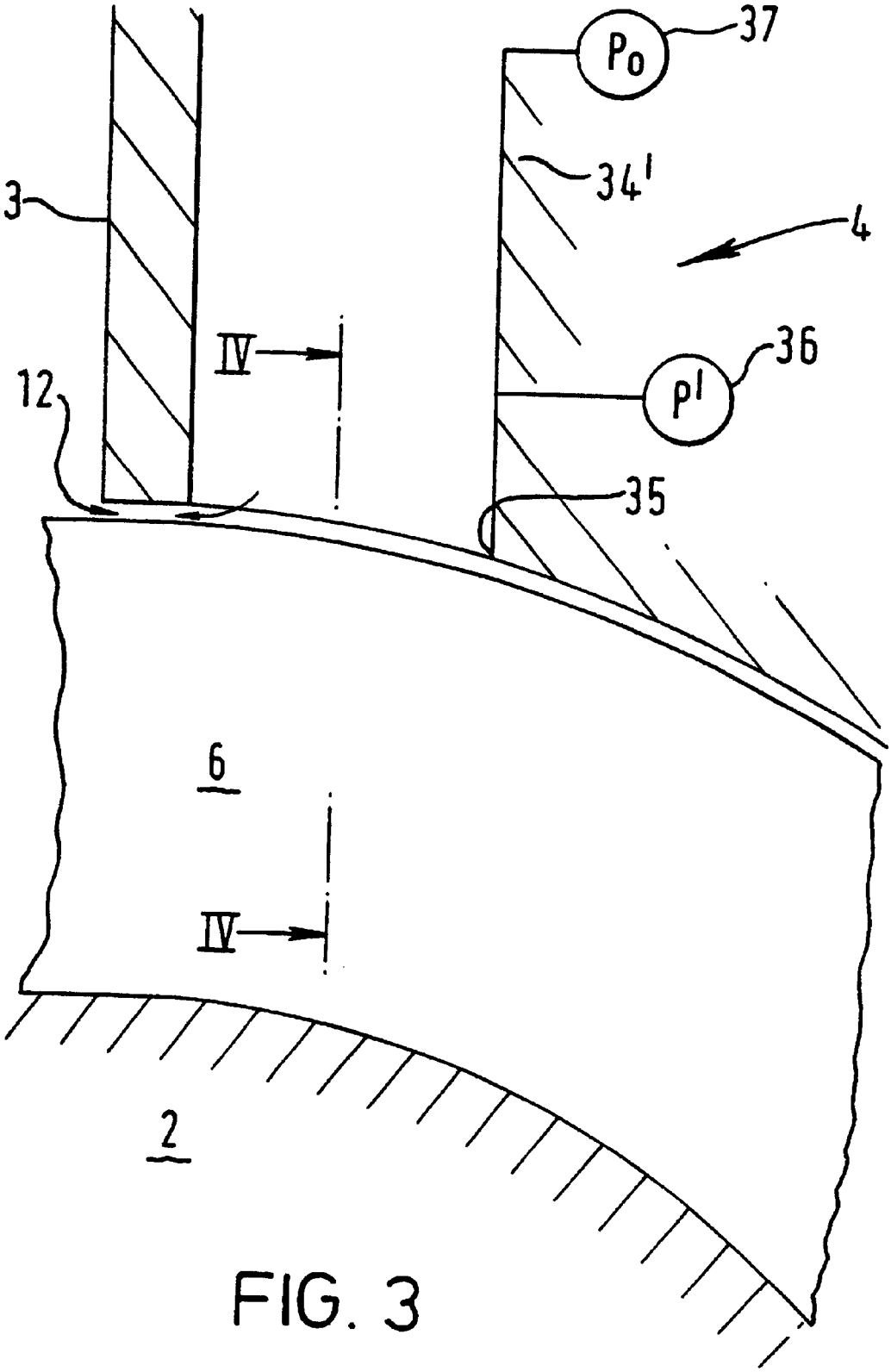
FIG. 3 is an enlarged sectional elevation of a portion of the wheel and shoe of the machine where feedstock enters the passage and showing one gap sensor.

A gap 12 is formed between the periphery of the wheel 2 and the shoe 3 which can be seen enlarged (approximately 10 times larger than life) in FIG. 3. The size of the gap 12 during machine operation is optimally approximately 0.2 mm. During the machine operation some of the material of the bar 6 'extrudes' through the gap onto the circumferential surface of the wheel 2. This material is separated from the wheel 2 by means of a scraper assembly 41 shown in detail in FIGS. 6 and 7 as described later.

The wheel 2 and the shoe 3 are subject to deformation cause by mechanical and thermal strain. This deformation tends to increase the gap size during extrusion. The removal of the strain when the feedstock supply is stopped results in a sudden reduction in the gap size. The machine must continue to run for a period after the feedstock supply is stopped in order to discharge feedstock from the passage. If the gap size were of the order of 0.2 mm the sudden reduction in strain caused by the discharge of the passage would cause the wheel to collide with the shoe resulting in serious damage.

To alleviate the aforementioned problem the shoe 3 is mounted on a support structure comprising a pair of wedge assemblies, in particular, a first vertical displacement wedge assembly 13 for displacing the shoe 3 vertically and a second horizontal displacement wedge assembly 14 for displacing the shoe 3 horizontally.

The vertical displacement wedge assembly 13 comprises a base bearing member 15, a wedge 16 disposed with an elongate horizontal face bearing against the bearing member 15 so that an elongate inclined face faces upwards.

A ramp 17 has a face inclined at the same angle as the wedge and bearing against the inclined face of the wedge 16. The ramp 17 has a horizontal face opposite the inclined face which bears against the shoe 3. A shim may be interposed between the shoe and the ramp 17. The ramp is mounted in the chassis to be displaceable in the vertical direction only. The wedge 16 and ramp 17 are separated by a low friction spacer (not shown) which may be made of PTFE. Included in the wedge assembly 13 is a double acting vertical displacement hydraulic ram 19 connected to the wedge 16 by a con-rod 20. Hydraulic fluid supply to the extension chamber of the hydraulic ram 19 is controlled by a right displacement air hydraulic intensifier 21. Hydraulic fluid supply to the retraction chamber of the ram 19 is controlled by a left air hydraulic intensifier 22.

The horizontal wedge assembly 14 comprises a back bearing member 23 which is removably secured by pins 23' into the chassis 1. An inner vertical face of the back bearing member 23 provides a bearing surface to support a vertical face of a wedge member 24 of the horizontal displacement wedge assembly 14. An inclined face of the wedge 24 bears against a complimentarily inclined face of a ramp member 25. The ramp member 25 bears against a vertical face of the shoe 3 and is mounted to be displaceable horizontally only. A shim may be interposed between the ramp 25 and the shoe. A double acting hydraulic ram 26 is linked to the wedge 24 by a con-rod 27. An up air hydraulic intensifier 28 controls the delivery of hydraulic fluid to the up hydraulic ram 26. Displacement transducers 29 monitor the positions of the wedge members 16 and 24 to enable fast movement during start up and shut down.

Because the wedge 24 must be readily removable from the machine in order to gain access to the shoe 3 it cannot be very rigidly fixed to the con rod 27. To ensure no backlash in the horizontal movement a down hydraulic ram 30 is provided to impose a constant downward pressure on the top of the wedge 24. This also helps to ensure smooth movement of the wedge by overcoming any stiction which may occur between the wedge and bearing surfaces-despite of friction reducing measures which may be implemented such as PTFE coatings.

The air/hydraulic intensifiers deliver a precise volume, of hydraulic fluid every time they are actuated by a pneumatic air signal delivered to the intensifier.

Typically the volume may be 2 ml. One stroke from the intensifier wilt therefore result in a the wedge attached to the associated hydraulic ram moving by a single increment resulting in an incremental shoe movement of typically 0.04 mm. Thus when the control device compares a desired gap size with an actual sensed gap size the hydraulic rams can be driven the required number of strokes to achieve the desired gap size.

In the radial mode of extrusion shown in FIG. 1 the radial shoe 3 forms a passage mostly in an upper quarter segment of the wheel 2. The pressure imposed on the radial shoe 3 by the feedstock in the passage has an upwardly directed resultant force. It is therefore necessary to provide a second down hydraulic ram 31 to urge the shoe 3 down onto the vertical movement wedge assembly 13. An air/hydraulic intensifier 32 is arranged to control the delivery and discharge of hydraulic fluid to the second down hydraulic ram 31.

Figure 2:
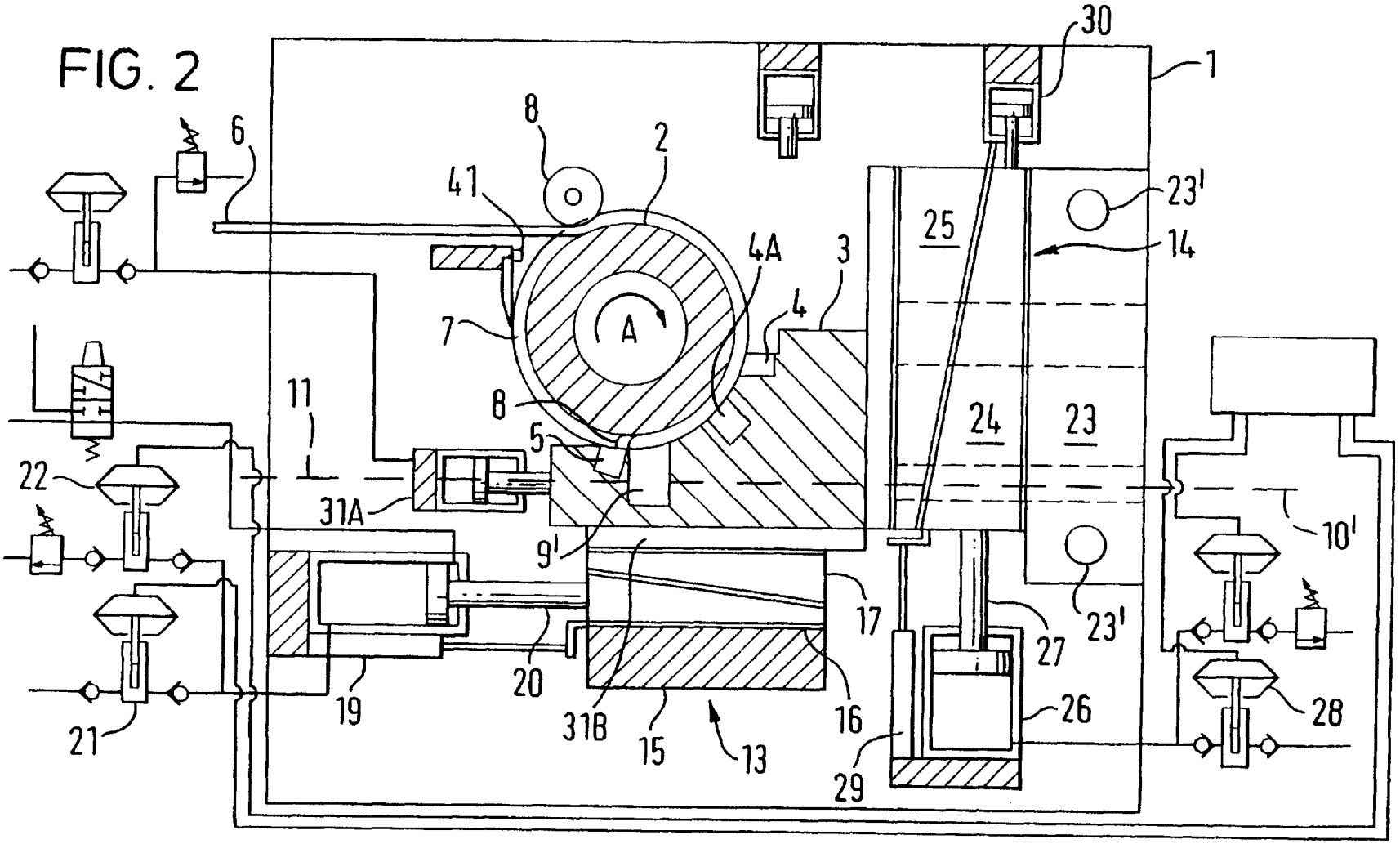

In the tangential operation mode of FIG. 2 the tangential shoe 31 forms the passage in a lower quadrant of the wheel 2. In consequence the pressure applied by the feedstock entrained in the passage includes a large; net downward component on the tangential shoe 31. Although this makes the second down hydraulic cylinder 31 unnecessary in the tangential mode of operation, the fact that the load on the shoe is near vertical and has only a small horizontal component makes the provision of a horizontal shoe displacement ram 31A in the chassis desirable. The horizontal shoe displacement ram 31A is mounted in the chassis 1 and acts directly against the shoe 31 to overcome friction between the shoe and a horizontal support plate 31B by pushing the tangential shoe 31 against the ramp 25.

It will be appreciated from FIGS. 1 and 2 that a single continuous extrusion machine may be adapted by installation of the appropriate radial shoe 3 or tangential shoe 31 to run in either the radial or tangential modes.

The delivery of air to each air/hydraulic intensifier is coordinated by a control device (not shown) of the control means, such as a programmable computer or dedicated processor which cause the discharge of pneumatic control air from an air reservoir 33 to the air/hydraulic intensifiers via solenoid valves 33A. Rams 31 or 31A are continuously pressurised to push the shoe 3 or 3' against either a vertical shoe support plate 31C, or the horizontal shoe support plate 31B. The shoe support plates 31B, 31C are each supported by the horizontal and vertical wedge assemblies 13 and 14. When the wedge assemblies move the system towards the opposing ram, e.g. the horizontal wedge assembly 14 moves the shoe 3 towards the ram 31 fluid is forced from the ram cylinder through the pressure relief valve and when the shoe is moved away fluid is pumped into the ram 31. Thus a pre-set fluid pressure is maintained in the ram 31 or 31A and corresponding force is applied to the shoe 3, 3' to urge it against the wedge assembly 31,14 opposite the ram.

To summarise cylinders 19 and 26 are master cylinders which control the position of the wedges and the shoe. Cylinders 30, 31 and 31A are slave cylinders which are continuously pressurised to maintain a constant thrust. If the master cylinders are moved oil is forced in or out of the slave cylinders to maintain the required thrust.

Each 3 air/hydraulic intensifier is equipped with a microswitch which senses each stroke of hydraulic fluid discharge and transmits this information to the control device which can thus deduce the consequent displacement of the shoe 3,3'. The control means in this instance may be understood to consist of the control device and the pneumatic control system comprising the reservoir 33, the pneumatic valves and the air/hydraulic intensifiers The control means is responsive to the size of the gap 12 sensed by the first, second and third gap sensors 4, 4A and 5. The first gap sensor 4 is located adjacent the entrance to the passage, the second gap sensor 4A is located adjacent the shoe and upstream of the tooling 9 and the third gap sensor is located downstream of the abutment 8. Each of the gap sensors 4, 4A and 5 are similar in operation and differ significantly only in location so only the gap sensor 4 shown diagrammatically in FIGS. 3 and 4 will be described in detail. The gap sensor 4 comprises a gas supply pipe 34 preferably between 0.75 m and 2.910 m long; The pipe communicates with a port 35 formed alongside the tooling. The port 35 overlies the rim of the wheel 2 adjacent the groove 7. The end of the pipe 34 remote from the gap 12 communicates with a solenoid valve 38. The pipe 34 is of similar diameter to the port 35. The port 35 has a diameter about four times that of the gap size. Pressurised gas is delivered to the solenoid valves 38 from an accumulator 39 via a pipe 40 and a pressure transducer 37. The pressure transducer 36 is located near (about 0.05 m) from the port 35. Theory indicates that measurement of a maximum gap size of 1.375 mm requires a port diameter of 5.5 mm. However, the experimentally derived results shown in FIG. 5 indicate that the correlation between the pressure ratio P/Po and gap size is sufficiently linear over a range from 0.2 to 2 mm for a 5.5 mm.

To sense the gap size a gas which may be air but may also be a non-oxidising gas such as nitrogen, or a noble gas, is discharged down the tube 34 at a pressure sufficient to achieve sonic velocity at the aperture 35. As can be seen from FIG. 4, when the aperture is choked and the flow upstream is subsonic, the ratio of the downstream pressure to the upstream pressure is dependent mainly upon the size of the gap 12. Since the pressure transducers may be accurate up to +–3447 N/M2 (0.5 psi) the gap. size may be sensed to an accuracy of about +0.05 mm.

The pressure transducers 36 and 37 communicate the sensed pressures to the control device where the sensed pressures may be converted to dimensions and compared with a pre-set desired gap size. When the control device senses a deviation from the pre-set gap size it issues control signals to the air/hydraulic intensifiers to deliver or discharge hydraulic fluid from the rams so that the shoe is displaced to bring the gap size back towards the desired size 4. As can be seen from experimentally derived calibration curve of FIG. 4, the pressure ratio P/P. is approximately linear when the inlet pressure P. is 344750 N/M2 (50 psi) over a range of gap size from 0–2 mm and the tube length is 750 mm.

Figure 4:
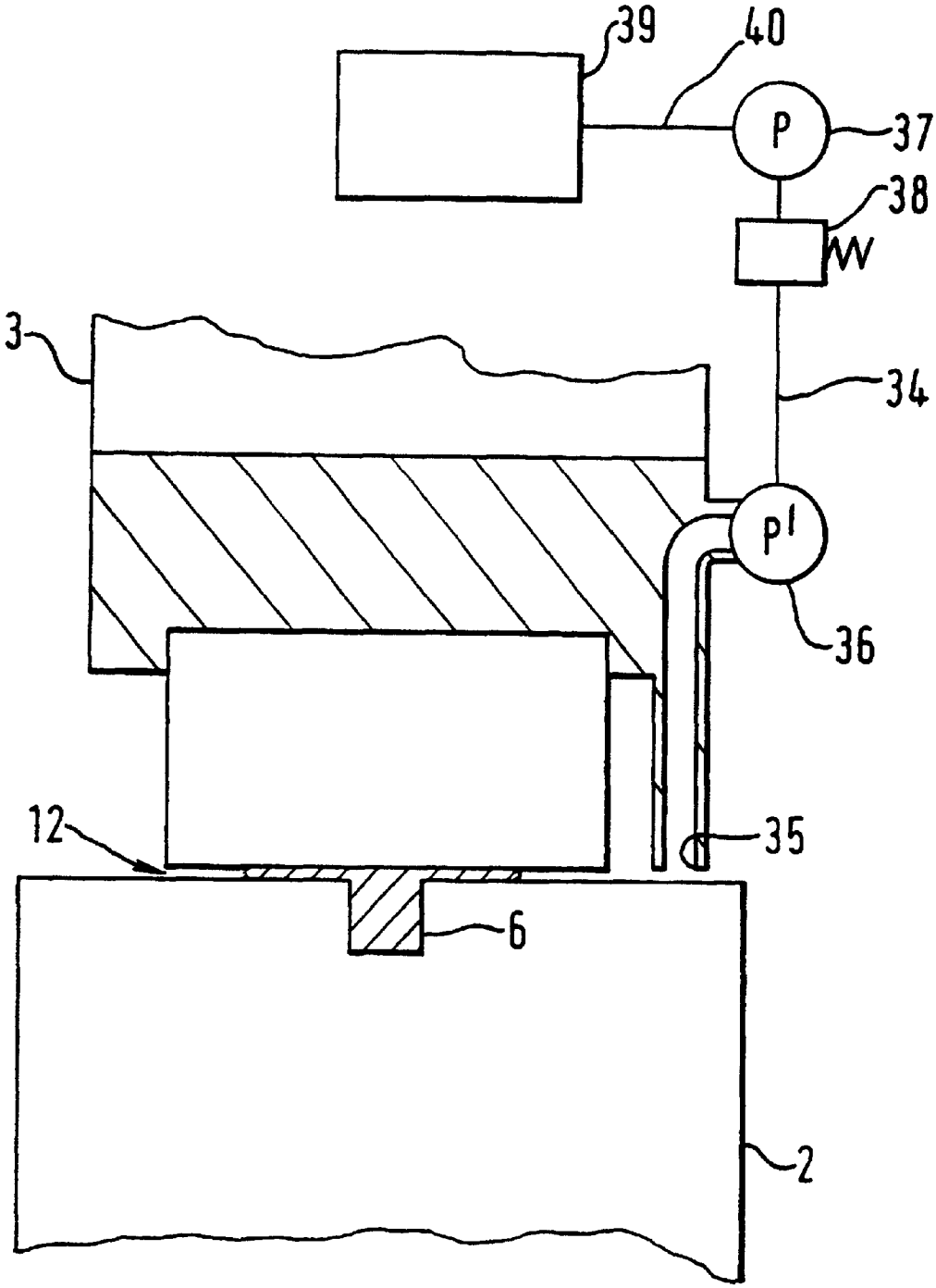
FIG. 4 is a partly diagrammatic sectional elevation on the line IV—IV in FIG. 3, on a reduced scale.
Figure 5:
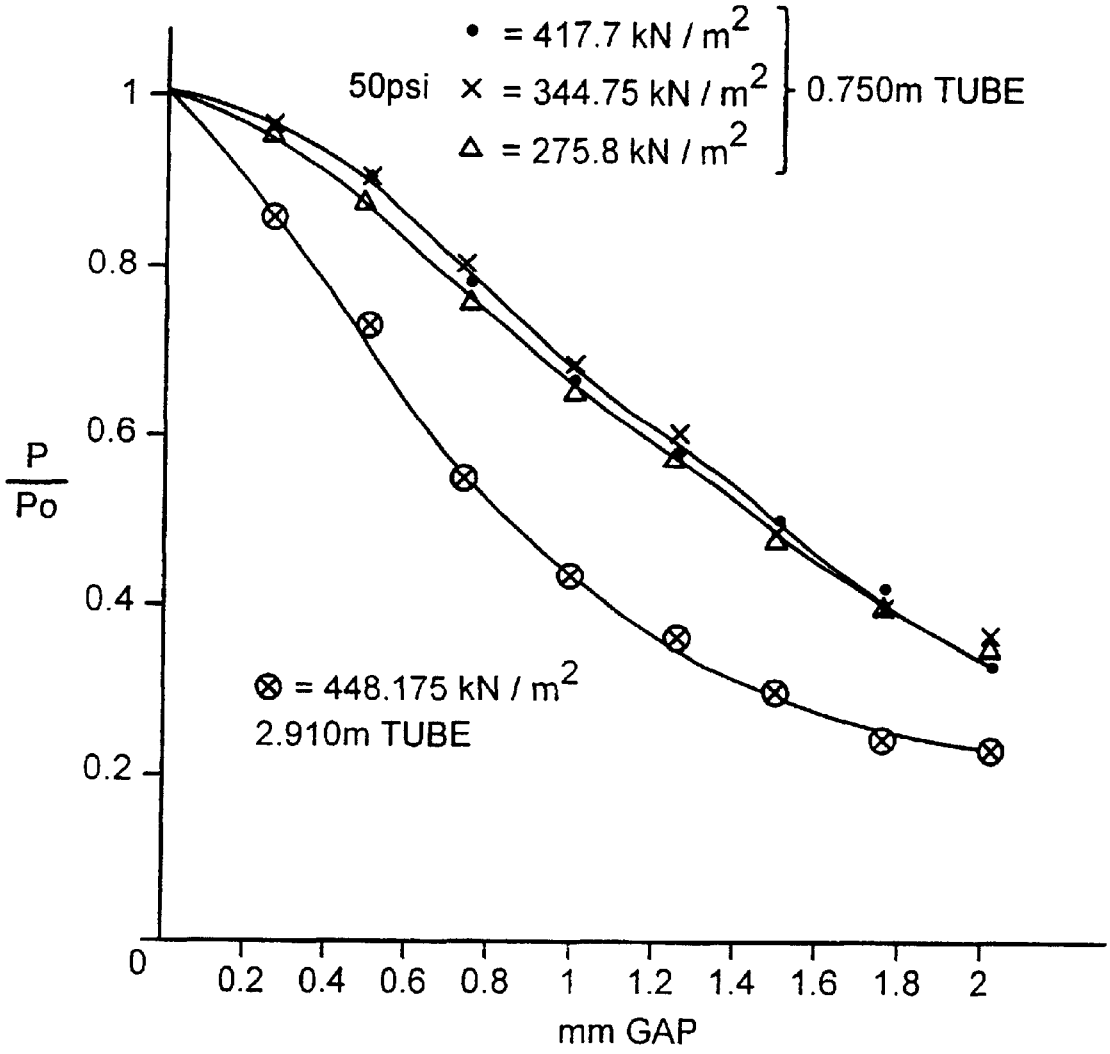
FIG. 5 is a graph showing the calibration of a gap sensor.

The calibration of the gap sensor shown in FIG. 4 consists of the following steps, with the wheel stationary and no feedstock in the machine.

1. Pre-set the gap at 0.0 mm, this may be determined when P=PO
2. Increment the gap by 0.1 mm by applying an appropriate number of air pulses to the air/hydraulic intensifiers,
3. If transducer 37 senses that the pressure in the accumulator is 344.75 kN/M2 open solenoid valve 38 for 3 seconds.
4. Two seconds after opening the valve 38 read the pressures from transducer 37 and 38 to the control device.
5. Calculate P/P. and PI/P. and map against gap size.
6. Increment the gap by 0.1 mm.
7. Repeat steps 1–6 until gap =2 mm.

the gap sensors have been calibrated the operation when extruding material consists of the steps of:

1. With solenoid valves 38 shut, read P from transducer 38.
2. if PO==344.75 N/m2 open valve 38 for three seconds
3. Two seconds after valve opens read P and P,'
4. Calculate P/PO and read gap from the calibration map.
5. During start up measure the gap every ten seconds.
6. During steady running measure the gap every minute.
7. If the actual gap size differs significantly from the previous desired or previous gap size actuate air/hydraulic intensifiers with sufficient pulses to converge the actual gap size to the desired gap size.

EXAMPLE.

An example of a continuous extrusion machine start procedure using the previously described continuous extrusion machine requires the machine to extrude through a high pressure die. To achieve this the wedge assemblies 13 and 14 are adjusted so that, when cold, the gap 12 has an upstream width of 0.4 mm at an upstream position adjacent the second gap sensor 4, an intermediate width of 0.2 mm at an intermediate position adjacent the second gap sensor 4A and a downstream width of 0.5 mm at a downstream position adjacent the third gap sensor 5. The scraper is set to prevent any build up of flash. As the machine starts up the machine temperature approaches 550 C and the gap is adjusted until it is parallel with the upstream and downstream gaps set to 0.2 mm.

The embodiments may be operated automatically by the control device responding to signals indicative of the gap size from the first second and third gap sensors. However, the machine may be operated manually by an operator observing the appearance and amount of the flash layer and moving the shoe accordingly.

Figure 6:
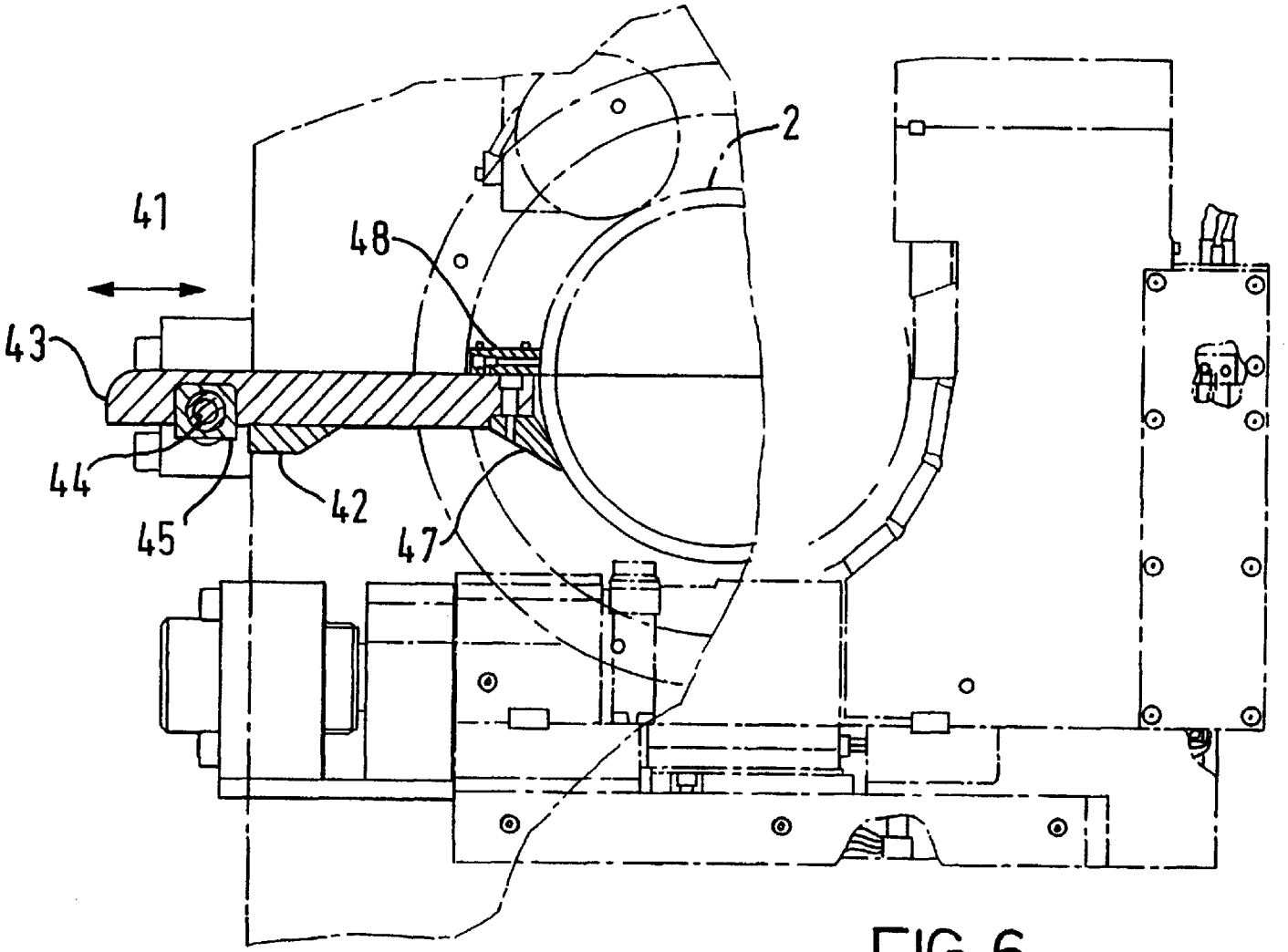
FIG. 6 is a part sectional elevation of the scraper blade assembly in a machine.
Figure 7:
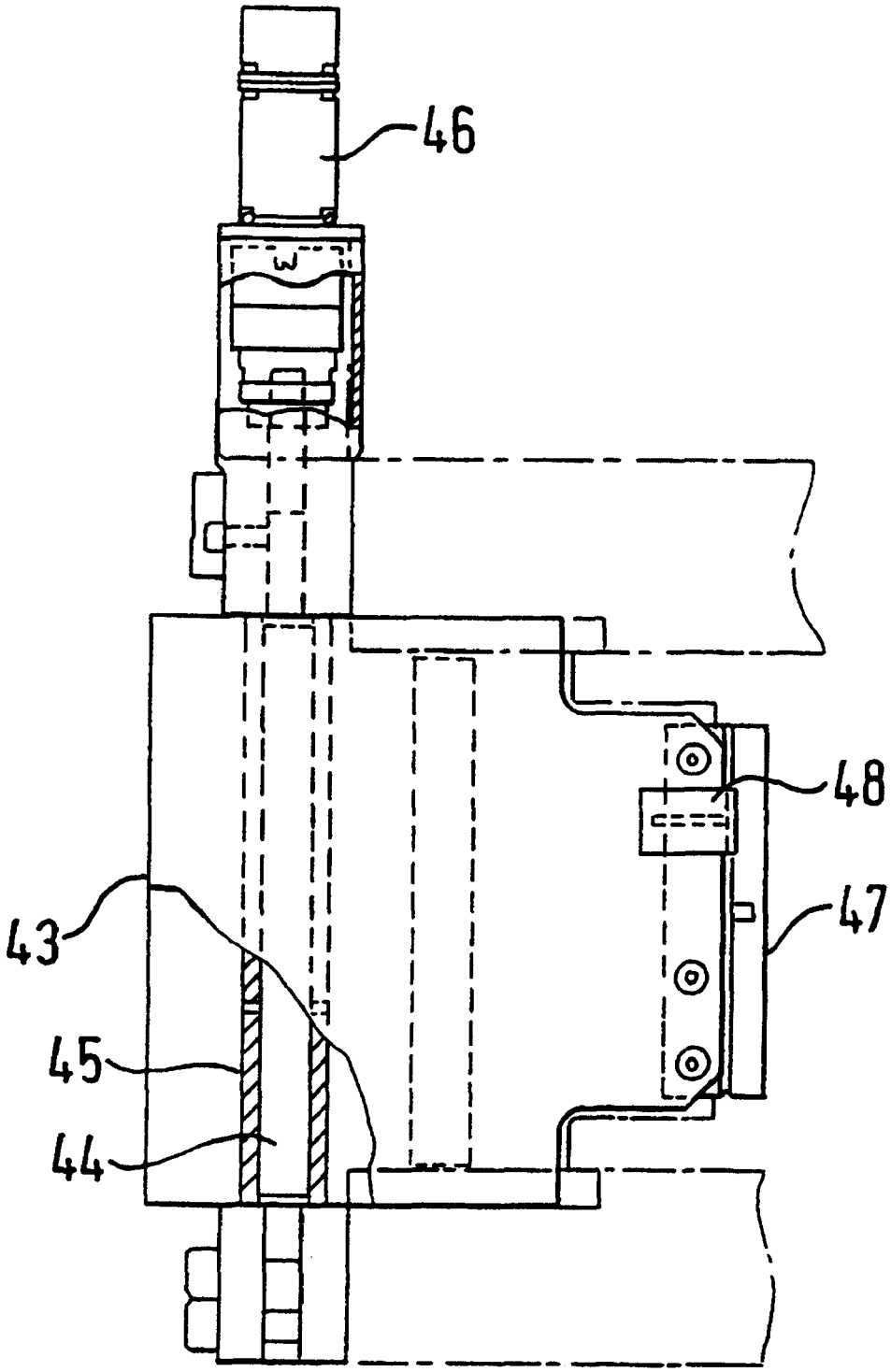
FIG. 7 is a part sectioned plan view of the scraper blade assembly of FIG. 5

Referring no to FIGS. 6 and 7, the scraper assembly 41 comprises a horizontal support bearing 42 extending parallel to the axis of the wheel 2 to support a scraper carrier 43 which extends substantially radially towards the wheel 2. An eccentric shaft 44 extends parallel to the wheel axis through a bearing block 45 received into a recess in the scraper carrier 43. The eccentric shaft 44 is driven to rotate by a geared motor 46 which by virtue of the eccentric rotation of the shaft 44 causes the scraper carrier 43 to be displaced radially toward or away from the wheel 2. A scraper blade 47 is mounted via bolts or any other suitable device onto the end of the scraper carrier 43 so that when the scraper blade 47 is displaced to a desired position determined by the control the scraper blade 47 removes unwanted flash from the wheel rim. Positioning the scraper blade accurately is important in order to prevent fouling as the wheel rim re-enters the shoe. However, problems arise in setting the scraper position relative to the wheel because of thermal expansion and blade tip wear during machine operation which alters the relative position of the scraper blade 47 and the wheel 2. To alleviate this problem a sonic gap sensor 48 is mounted on the tip of the scraper carrier 43 adjacent the wheel 2. The gap sensor 48 senses the separation of the scraper carrier tip and the wheel rim which is communicated to the control means which can thus simply determine the actual position of the scraper blade tip relative to the wheel rim. Where there is any difference in the desired and actual position of the scraper blade tip the control steps the motor 46 to reposition the scraper blade tip to reduce the difference.

It will be appreciated that numerous alternative devices may be employed to achieve displacement of the scraper carrier including hydraulic rams, ball screws, worm drives and rack and pinion drives.

What is claimed is:

1. A continuous extrusion machine having a chassis (1) supporting a wheel (2) for rotation and a shoe (3) enveloping a span of the periphery of the wheel (2) and co-operating with a groove (7) formed in the periphery of the wheel (2) to form a passage, a support mechanism supporting said shoe (3) [and/or wheel (2)] to be relatively displaceable in a direction perpendicular to an axis of rotation of the wheel (2) during use, a gap sensor system able to sense the size and shape of a gap (12) between the wheel periphery and the shoe (3) when the machine is operating, and a control device responsive to the gap sensor system to adjust the support mechanism to displace the shoe (3) relative to the wheel (2), said support mechanism comprising:

a first wedge assembly disposed to displace the shoe in a first direction perpendicular to the axis of rotation of the wheel, and a second wedge assembly disposed to displace the shoe in a second direction perpendicular to the rotary axis of the wheel and to the first direction, whereby the size and shape of the gap can be controlled and altered in response to the size and shape of the gap sensed by the gap sensor system.

2. A continuous extrusion machine according to claim 1 wherein said first wedge assembly comprises a first wedge (16) and said second wedge assembly comprises a second wedge (24) and wherein each wedge (16, 24) is displaced by hydraulic rams (19, 26).

3. A continuous extrusion machine according to claim 3, wherein one of the wedge assemblies is arranged to displace the shoe in the horizontal direction and includes an up hydraulic ram with which to displace the wedge up and a down hydraulic ram to impose a constant downward pressure on the wedge, so that the wedge assembly can readily be removed from the machine.

4. A continuous extrusion machine according to claim 1 wherein the gap sensor [system comprises a gap sensor (4, 4A, 5) which] senses the gap size directly.

5. A continuous extrusion machine according to claim 4 wherein at least two gap sensors (4, 4A, 5) are provided each being peripherally spaced from the other to sense the size and shape of the gap (12).

6. A continuous extrusion machine according to claim 4 wherein the gap sensor is a sonic gap sensor.

7. A continuous extrusion machine according to claim 1 wherein the gap sensor system includes a first gap sensor (4) located at the entrance to the passage, a second gap sensor (4A) located immediately upstream of a tooling (9) in the shoe (3) and a third gap sensor (5) located downstream of an abutment (8).

8. A continuous extrusion machine according to claim 1 wherein a scraper blade (47) is supported on a scraper carrier (43) for radial displacement with respect to the rim of the wheel (2), said scraper carrier (43) being driven by a motor (46) controlled by the control device in accordance with signals received from a gap sensor (48) mounted on the scraper carrier and the periphery of the wheel (2).

9. A continuous extrusion machine according to claim 8 wherein the motor displaces the scraper blade by rotation of an eccentric shaft (44).

10. A continuous extrusion machine according to claim 9 wherein the gap sensor senses the gap directly.

11. A continuous extrusion machine according to claim 8 wherein the gap sensor (48) is a sonic gap sensor.

12. A continuous extrusion machine according to claim 1 wherein each wedge assembly comprises a longitudinally displaceable wedge arranged to bear against an inclined face of a ramp, said ramp being constrained to be displaceable in one of the first or second direction only to displace the shoe.

13. A method of operating a continuous extrusion machine wherein feedstock is entrained in a groove (7) formed in the periphery of a wheel (2) rotating in a chassis (1) and drawn into a passage formed between the groove (7) and a shoe (3), said passage being obstructed by an abutment supported by the shoe (3) so that friction between the shoe (3) and the abutment will cause the feedstock to extrude through a die supported in the shoe (3), comprising the steps of:

sensing the actual size and shape of a gap (12) between the wheel (2) and the shoe (3), comparing the actual size and shape of the gap (12) with a predetermined or previous gap size and shape in a control device to determine if there is a difference, said control device responding to a difference to control a support structure which supports the shoe (3) in the chassis (1) to displace the shoe (3) on two axes each perpendicular to the axis of rotation of the wheel (2) so that the gap (12) size and shape is changed to reduce the difference.

14. A method according to claim 13 wherein the gap size is sensed directly at at least two positions spaced peripherally around the passage in order to sense the shape of the gap.

15. A method according to claim 14 wherein the predetermined gap size is set to a desired gap size while the machine is extruding.

16. A method according to claim 13 wherein the gap size is sensed at at least one position comprising the steps of:

i. blowing a pressurised gas through the gap (12) at at least one point adjacent the passage, ii. adjusting the gas pressure to be sufficient to that the gap (12) is choked, iii. sensing the gas pressure upstream of the gap (12), iv. communicating the gas pressure to the control means, v. calculating the actual gap (12) size from the gas pressure.

17. A method according to claim 16 wherein the gap size is sensed at at least two circumferentially spaced points adjacent the passage to determine the shape of the gap (12).

* * * * *